US010968900B2

(12) United States Patent
Smith

(10) Patent No.: US 10,968,900 B2
(45) Date of Patent: Apr. 6, 2021

(54) HIGH PRESSURE PUMP

(71) Applicant: Carlisle Fluid Technologies, Inc., Charlotte, NC (US)

(72) Inventor: Alan Smith, West Moors (GB)

(73) Assignee: Carlisle Fluid Technologies, Inc., Scottsdale, AZ (US)

( * ) Notice: Subject to any disclaimer, the term of this patent is extended or adjusted under 35 U.S.C. 154(b) by 275 days.

(21) Appl. No.: 15/551,868

(22) PCT Filed: Jan. 29, 2016

(86) PCT No.: PCT/GB2016/050202
§ 371 (c)(1),
(2) Date: Aug. 17, 2017

(87) PCT Pub. No.: WO2016/132097
PCT Pub. Date: Aug. 25, 2016

(65) Prior Publication Data

US 2018/0066638 A1 Mar. 8, 2018

(30) Foreign Application Priority Data

Feb. 18, 2015 (GB) ..... 1502686

(51) Int. Cl.
*F04B 9/04* (2006.01)
*F04B 15/02* (2006.01)
(Continued)

(52) U.S. Cl.
CPC ..... *F04B 11/0066* (2013.01); *F04B 9/042* (2013.01); *F04B 11/005* (2013.01);
(Continued)

(58) Field of Classification Search
CPC .. F04B 9/042; F04B 15/02; F04B 2201/1213; F04B 11/0066; F04B 11/0058; F04B 11/005; F04B 53/08; F04B 17/03
See application file for complete search history.

(56) References Cited

U.S. PATENT DOCUMENTS 1,766,610 A * 6/1930 Davis ..... F04B 1/00 74/55
3,650,639 A * 3/1972 Greene ..... F04B 35/04 417/368
(Continued)

FOREIGN PATENT DOCUMENTS

CN 1208987 A 2/1999
DE 1800142 A1 4/1970
(Continued)

OTHER PUBLICATIONS

Machine Translation of JP 59-119992.*
(Continued)

*Primary Examiner* — Christopher S Bobish
(74) *Attorney, Agent, or Firm* — Fletcher Yoder, P.C.

(57) ABSTRACT

A positive displacement pump for pumping a fluid mastic comprises a plurality of cylinders each having a piston arranged for reciprocal motion within the cylinder. Movement of the piston in a first direction draws the fluid into the cylinder and movement in a second, opposite direction pumps the fluid out of the cylinder. A variable speed electric motor is drivingly coupled to a cam arrangement providing a reciprocating drive to the pistons. The cam arrangement comprises cams shaped and arranged to drive each piston in the first direction over less than half of a rotational cycle and to drive each piston in the second direction over the remainder of the rotational cycle. The cams are arranged to drive the pistons out of phase with one another.

13 Claims, 8 Drawing Sheets

(51) Int. Cl.
*F04B 11/00* (2006.01)
*F04B 17/03* (2006.01)
*F04B 53/08* (2006.01)

(52) U.S. Cl.
CPC ..... *F04B 11/0058* (2013.01); *F04B 15/02* (2013.01); *F04B 17/03* (2013.01); *F04B 53/08* (2013.01); *F04B 2201/1213* (2013.01)

(56) References Cited

U.S. PATENT DOCUMENTS 4,028,018 A * 6/1977 Audsley ..... F04B 1/0439 417/534
4,600,365 A * 7/1986 Riggenmann ..... F04B 11/0066 417/246
4,687,426 A * 8/1987 Yoshimura ..... F04B 1/043 417/539
4,753,581 A * 6/1988 Hiscock ..... F04B 11/0066 417/269
4,790,732 A * 12/1988 Yamatani ..... F04B 9/042 417/539
4,797,834 A * 1/1989 Honganen ..... F04B 11/0058 137/2
4,964,985 A * 10/1990 Goulder ..... F04B 11/0058 210/101
5,145,339 A * 9/1992 Lehrke ..... F04B 1/02 417/430
5,195,879 A * 3/1993 Reese ..... F04B 1/02 417/521
5,701,873 A * 12/1997 Schneider ..... F02M 59/34 123/462
6,079,313 A * 6/2000 Wolcott ..... F04B 1/2042 417/269
6,089,849 A 7/2000 Bulgrin et al.
6,764,285 B1 * 7/2004 Kellner ..... F02M 59/06 123/450
7,004,121 B2 * 2/2006 Moe ..... F04B 1/146 123/56.2
7,938,632 B2 * 5/2011 Smith ..... F04B 9/042 417/415
8,084,976 B2 * 12/2011 Hashimoto ..... H02P 21/0003 318/400.02
8,182,246 B1 * 5/2012 Rohring ..... F04B 1/0413 417/521
2011/0286867 A1 11/2011 Lesko
2015/0129064 A1 * 5/2015 Reilly ..... F04B 1/128 137/605

FOREIGN PATENT DOCUMENTS

DE 1653472 A1 * 8/1971 ..... F04B 9/042
DE 102013212237 A1 12/2014
GB 1487316 A 9/1977
JP S40-17343 4/1962
JP 61-040467 A 2/1986
JP S63-129174 6/1988
JP H04-19938 U 2/1992
JP H10-311274 A 11/1998
JP 2011106285 A 6/2011
JP 2013502522 A 1/2013
KR 10-1997-0021741 A 5/1997

OTHER PUBLICATIONS

Russian Office Action for RU Application No. 2017132299 dated Aug. 21, 2018, 14 pgs.
Japanese Office Action for JP Application No. 2017-543994 dated Sep. 4, 2018, 4 pgs.
Chinese Office Action for CN Application No. 201680022547.9 dated Sep. 17, 2018, 10 pgs.
Chinese Office Action for CN Application No. 201680022547.9 dated May 8, 2019, 17 pgs.
Korean Notice of Decision of Granting Patent for KR Application No. 10-2017-7025689 dated Dec. 1, 2018, 7 pgs.
Russian Decision to Grant for RU Application No. 2017132299 dated Jan. 15, 2019, 14 pgs.
Canadian Office Action for CA Application No. 2977014 dated Jun. 5, 2018, 3 pgs.
Korean Office Action for KR Application No. 10-2017-7025689 dated Jul. 25, 2018, 22 pgs.
International Search Report and Written Opinion for PCT Application No. PCT/GB2016/050202 dated Apr. 8, 2016, 13 pgs.
Japanese Second Office Action for JP Application No. 2017-543994 dated Jul. 30, 2019, 4 pgs.
Indian Examination Report for IN Application No. 201717029769 dated Nov. 20, 2019, 5 pgs.

* cited by examiner

HIGH PRESSURE PUMP

CROSS-REFERENCE TO RELATED APPLICATIONS

This application is a National Stage of PCT Application No. PCT/GB2016/050202 entitled "HIGH PRESSURE PUMP FOR PUMPING A HIGHLY VISCOUS MATERIAL," filed on Jan. 29, 2016, which is herein incorporated by reference in its entirety, and which claims priority to Great Britain Patent Application No. 1502686.7, entitled "HIGH PRESSURE PUMP," filed on Feb. 18, 2015, which is herein incorporated by reference in its entirety.

FIELD OF THE INVENTION

The present invention relates to a high pressure pump. More particularly, the invention relates to a pump for pumping a thick, highly viscous material such as mastic.

BACKGROUND

Mastic materials are used increasingly as sealants in product manufacturing facilities, particularly in automotive manufacturing. Typically the mastic material will be applied to a product (e.g. parts of a vehicle) as the product is moved through different stages in the manufacturing process, for example at different stations on a production line. When required to apply the mastic, an operator will simply reach for a mastic application gun, which is connected to an off-take on a mastic circuit that is supplied with the mastic at a high pressure. The high pressure is provided by a pump. Conventionally, the pumps used have been hydraulic or pneumatic positive displacement pumps.

However, because mastics are very thick and viscous, the capacity and pressure available from conventional pumps has meant that the circuits have to be short such that the mastic pumps and the reservoirs of the mastic materials being pumped have hitherto had to be located close to the stations where the off-takes are located. A further problem is that the fluids tend to thicken, and may even solidify if left stationary for too long a time, such as overnight or at a week-end when the plant is not being used. On large production lines, these problems have meant that a large number of mastic pumping circuits have been installed close to the points where the mastic is used, with a correspondingly large number of pumps and storage vessels (reservoirs).

Another problem with the pumping of mastics in these situations has been difficulty in operating the pump at very low speeds when only a small amount of mastic is being used, while still delivering the pressure required.

Similar problems can arise with other high viscosity fluids, such as epoxy materials or other types of adhesive.

This invention has therefore been conceived to provide a pump that overcomes or alleviates the foregoing problems.

SUMMARY

According to a first aspect of the present invention, there is provided a positive displacement pump for pumping a fluid mastic. The pump comprises a plurality of cylinders each having a piston arranged for reciprocal motion within the cylinder. Movement of the piston in a first direction draws the fluid into the cylinder and movement in a second, opposite direction pumps the fluid out of the cylinder. A variable speed electric motor is drivingly coupled to a cam arrangement providing a reciprocating drive to the pistons. The cam arrangement comprises cams shaped and arranged to drive each piston in the first direction over less than half of a rotational cycle and to drive each piston in the second direction over the remainder of the rotational cycle. The cams are arranged to drive the pistons out of phase with one another.

In embodiments, the positive displacement pump comprises three or more cylinders, wherein the cams are arranged to drive the pistons such that, at any position of the rotational cycle more than half of the pistons are being driven in the second direction. Having more than half of the pistons being driven in the second direction has the advantage that a greater piston area is used to exert force on the fluid, thereby generating a larger fluid flow. This arrangement also results in lower mechanical forces on the cam than would be the case if an equivalent fluid flow was to be produced by less than half of the pistons.

In embodiments, the cams are arranged such that a change in the direction of movement of any piston from the second direction to the first direction occurs at an angle of less than 5 (or even less than 2) degrees of rotation of the cams after another piston has changed direction from the first direction to the second direction. This provides that an increased number of pistons are pumping fluid prior to each change of direction of a piston from the second direction to the first direction.

In a piston, the change in direction at the end of a stroke does not occur instantaneously, because the piston must decelerate, before accelerating in the opposite direction. Therefore, in a conventional pump in which two pistons change direction simultaneously, there is a short time during which neither of the pistons is pumping at full pressure. This results in a brief drop in pressure of the outlet fluid. In embodiments of the invention described in the previous paragraph, for a short time, both pistons travel in the second direction, thereby reducing this pressure drop.

In embodiments, the variable speed electric motor is an ac motor. The ac motor may have an inverter, the inverter having a closed loop vector drive control. The ac motor may have a shaft encoder providing a signal indicating a position of the rotor to the inverter. The ac motor may include a forced convection fan arranged to provide cooling air to windings of the motor.

According to a second aspect of the present invention, there is provided a positive displacement pump for pumping a fluid mastic, the pump comprising a plurality of cylinders each having a piston arranged for reciprocal motion within the cylinder. Movement of the piston in a first direction draws the fluid into the cylinder and movement in a second, opposite direction pumps the fluid out of the cylinder. A variable speed ac motor is drivingly coupled to a cam arrangement providing a reciprocating drive to the pistons, wherein the ac motor has an inverter, the inverter having a closed loop vector drive control.

Embodiments described in the previous two paragraphs have the advantage that the motor can be run at very low speeds without stalling. This means that the pump can provide and maintain a high pressure to the fluid/mastic even when the quantity of mastic being used is very small (or zero). The pistons of this invention are capable of applying force to the fluid in the pump cylinders even when the pistons are not moving.

In embodiments, the ac motor has a shaft encoder providing a signal indicating a position of the rotor to the inverter.

In embodiments the ac motor includes a forced convection fan arranged to provide cooling air to windings of the motor. At normal high rotational speeds, the rotation of the windings through the air usually provides sufficient cooling to keep the windings from overheating. When the ac motor is rotating at very low speeds, or is stationary but still applying pressure to the fluid/mastic, the lack of movement means that there is no air flow past the motor windings. However, the windings continue to be supplied with a current to provide the required torque to the cams, and so will generate heat, which is removed by the air blown from the forced convection fan.

In embodiments of the first and second aspects of the invention, the cam arrangement includes a first cam and cam follower for each piston and a second cam and cam follower, 180° out of phase with the first cam and cam follower, wherein the first and second cam followers are connected to each other such that the distance between them is always the same, and the cam surfaces are shaped to ensure that the cam followers maintain contact with the respective cams at all times. This is advantageous because if contact between a follower and a cam surface is lost, even for a short time, this can give rise to a bouncing or knocking effect that increases wear of the follower and cam surfaces. Additionally, springs may urge the cam followers to maintain contact with their respective cams.

In embodiments, the cams have constant velocity cam surface profiles. An advantage of this is that the same mastic flow is achieved for a given motor rotation, regardless of the position in the cycle.

Embodiments of the present invention may comprise any of the above features taken in combination.

DETAILED DESCRIPTION

In typical known installations, such as in automotive production plant, a number of positive displacement pumps are used to pump the fluid, such as a mastic or adhesive, to the plant locations where the fluid is to be used. This may involve a first pumping stage that includes a medium pressure pumping station and a second pumping stage that includes a booster station with a number of small capacity high pressure pumps.

Typically the booster station will comprise four or five or more small capacity booster pumps, each capable of delivering a relatively small amount of fluid at a high pressure, with a varying number of these pumps pumping, to match demand. The high pressure pumps are normally located close to the plant locations where the fluid is to be used.

The high pressure pumps that are described below have been developed, in part, to improve upon the known booster pumping station arrangement.

Figure 1:
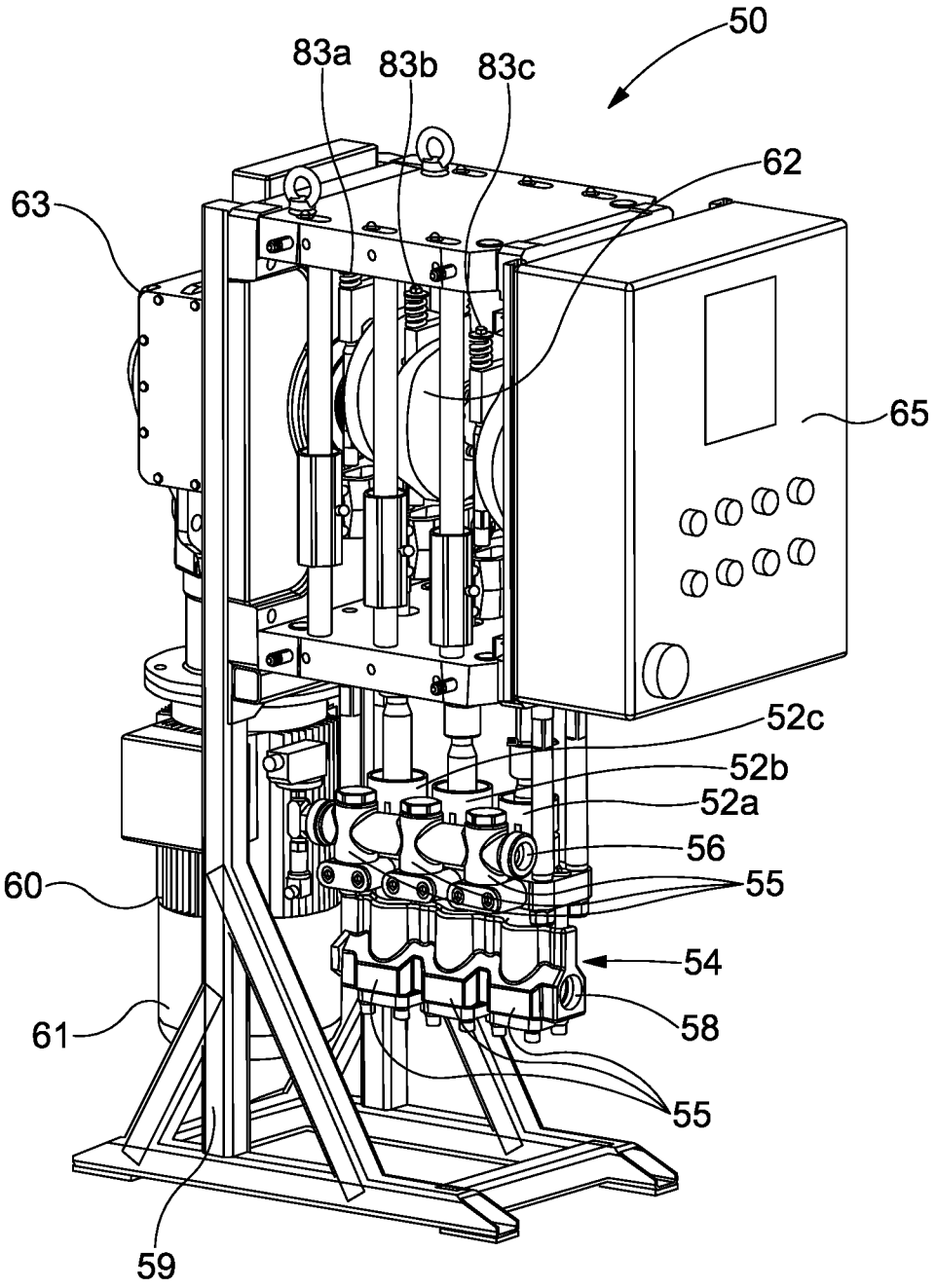
FIG. 1 is an illustration of an embodiment of a high pressure positive displacement pump.
Figure 2:
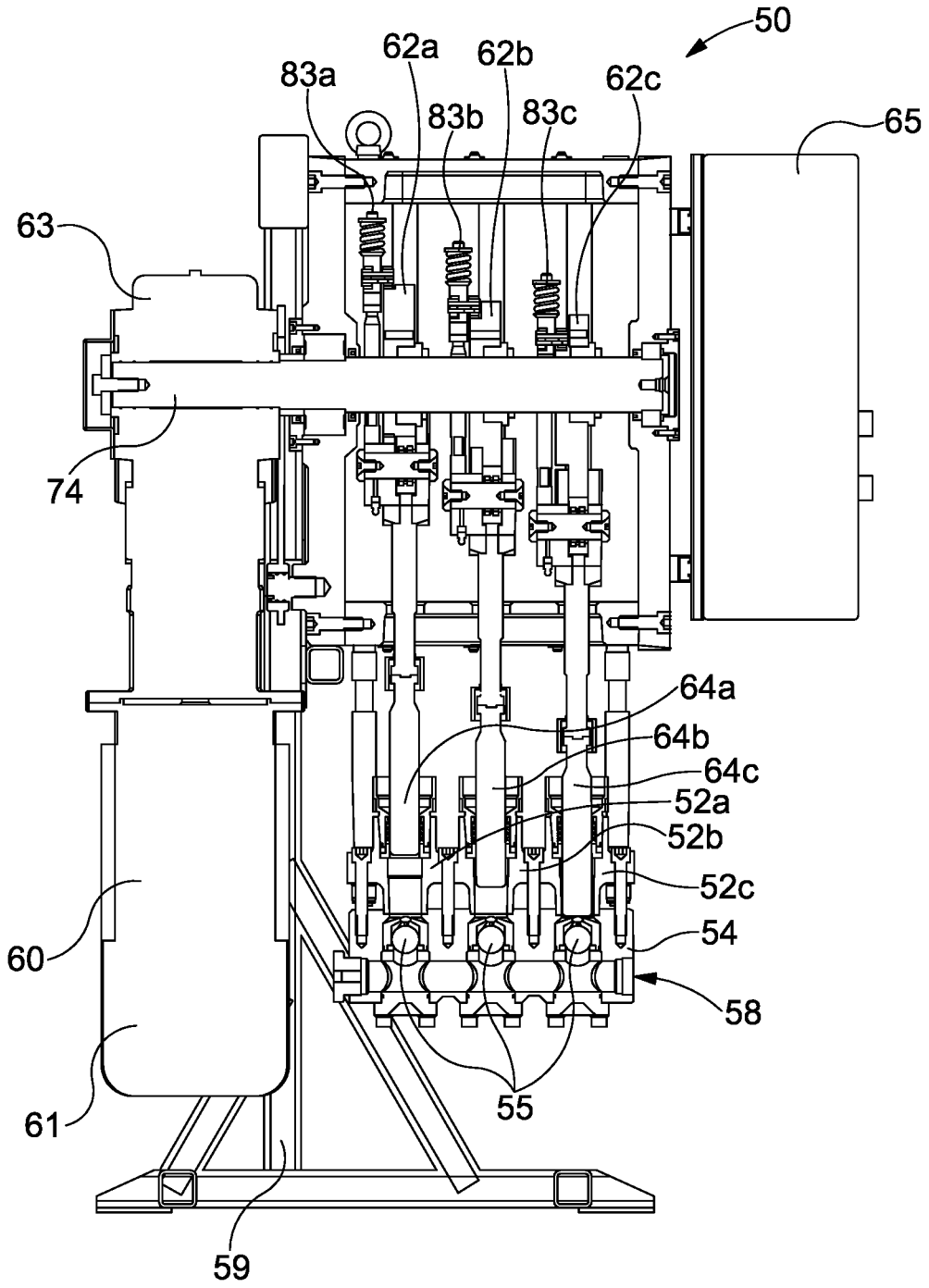
FIG. 2 is a cross section of an embodiment of the high pressure positive displacement pump of FIG. 1.

Referring to FIGS. 1 and 2, there are shown isometric and cross section views, respectively, of a positive displacement pump 50, according to an embodiment of the present invention. Positive displacement pump 50 is of a type particularly suitable as a replacement for the high pressure booster pumps described above. As shown in FIGS. 1 and 2, the positive displacement pump 50 has 3 cylinders 52*a*, 52*b*, 52*c*, each of which has a respective piston 64*a*, 64*b*, 64*c* arranged for reciprocal movement inside it. The cylinders 52*a*, 52*b*, 52*c* are formed in a pump body 54, in which is formed an inlet passage 58 for connection to a supply of fluid to be pumped, and an outlet passage 56 out of which the fluid is pumped. Also housed within the pump body 54 is an arrangement of check valves 55 that ensure that the fluid flows into and out of the pump in one direction as the pistons are moved within the cylinders.

The positive displacement pump 50 is shown mounted to a frame 59, which also supports a variable speed electric motor drive 60 providing a rotational drive to a cam shaft 74 of a cam arrangement 62, via a gearbox 63, and a control panel 65. The control panel 65 houses a controller configured to control the motor drive 60, including controlling the motor speed. Variable speed electric motor drive 60 also includes a forced convection fan 61. The cam arrangement 62 provides a reciprocating drive to the pistons in the cylinders 52*a*, 52*b*, 52*c*, in a manner explained in more detail below.

Figure 3A:
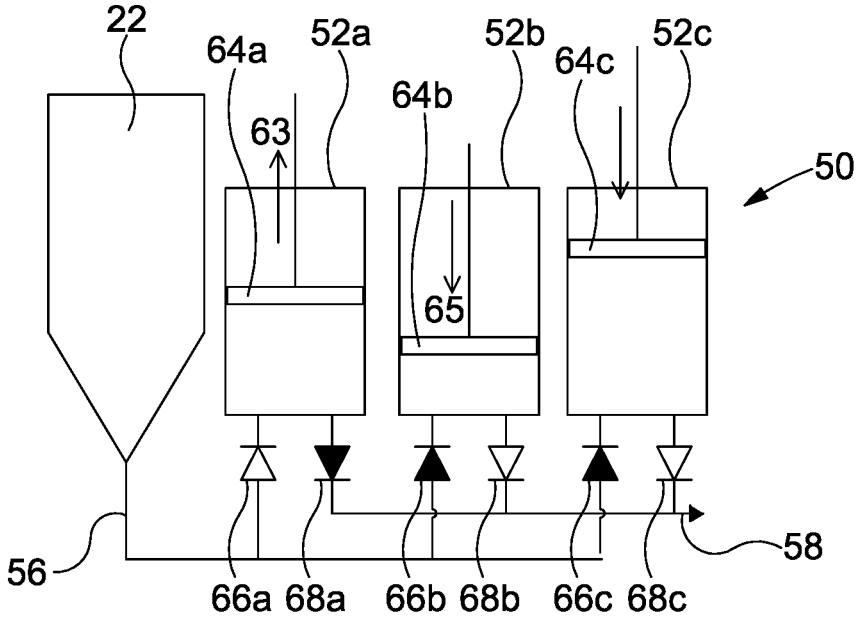
FIG. 3*a* is a diagram illustrating a principle of operation of a 3-cylinder high pressure pump in a first position of an operating cycle.
Figure 3B:
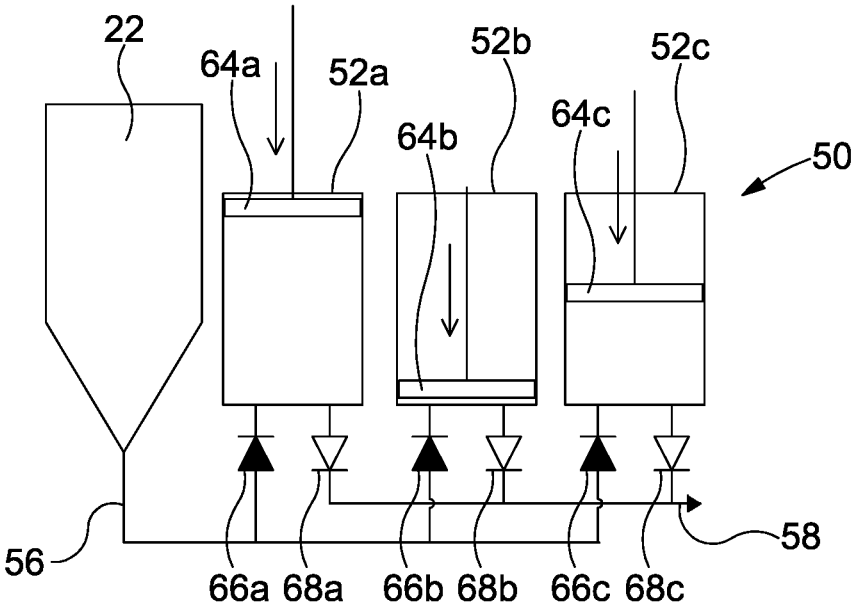
FIG. 3*b* is a diagram of the 3-cylider high pressure pump in a second position of an operating cycle.

FIGS. 3*a* and 3*b* illustrate a principle of operation of the 3-cylinder positive displacement pump 50. As shown in FIGS. 3*a* and 3*b*, the positive displacement pump 50 has 3 cylinders 52*a*, 52*b*, 52*c*, each of which has a respective piston 64*a*, 64*b*, 64*c* arranged for reciprocal motion within the cylinder. Each of the cylinders 52*a*, 52*b*, 52*c* is connected via an inlet check valve 66*a*, 66*b*, 66*c* to an inlet passage 58, and via an outlet check valve 68*a*, 68*b*, 68*c* to an outlet passage 56.

During the reciprocal cycle, the pistons go through a drawing stroke and a pumping stroke. These strokes are described in more detail below with respect to FIG. 3*a*, in which one piston 64*a* is in the drawing stroke and two pistons 64*b*, 64*c* are in the pumping stroke.

During the drawing stroke, the piston 64*a* moves upwards within the cylinder 52*a* in the direction indicated by arrow 63. The suction of the piston 64*a* opens the inlet check valve 66*a* and closes the outlet check valve 68*a*. Fluid is drawn along the inlet passage 58, through the inlet check valve 66*a* and into the cylinder 52*a*.

During the pumping stroke, the pistons move downwards within the cylinders 52*b*, 52*c* in the direction indicated by arrow 65. The pistons 64*b*, 64*c* increase the pressure of the fluid, which causes the inlet check valves 66*b*, 66*c* to close and the outlet check valves 68*b*, 68*c* to open. Fluid is pumped out of the cylinders 64*b* 64*c*, through the outlet check valves and along the outlet passage 56.

The pistons are driven by a variable speed electric motor (60) coupled to a cam arrangement (62). For the 3-cylinder pump system, the cams are shaped such that the drawing stroke occurs over a time period which is less than half the time period of the pumping stroke. The cams are arranged to drive the pistons out of phase with one another such that at any position during the rotation cycle, at least two of the pistons are pumping. This means that twice the piston area is used to exert force on the fluid, thereby generating twice the fluid flow than for a single cylinder. This arrangement also results in lower mechanical forces on the cam than would be the case if an equivalent fluid flow was to be produced by a single piston. A detailed description of the cams is given below with reference to FIG. 6.

FIG. 3*b* shows a different point in the same 3-cylinder pump cycle, in which the three pistons 64*a*, 64*b*, 64*c* are all pumping. This occurs shortly after a piston (in this case 64*a*) finishes drawing and begins pumping. The cams are arranged in such a way that a change in direction of movement of any piston (in this case 64*b*) from pumping to drawing occurs a small angle of rotation of the cams after another piston (in this case 64*a*) has changed direction of movement from drawing to pumping. This small angle of rotation of the cams is typically less than 5 degrees and may be less than 2 degrees in some cases. Further illustration of this feature of the invention is given later in the description with reference to FIGS. 6 and 7.

In a piston, the change in direction at the end of a stroke does not occur instantaneously, because the piston must decelerate, before accelerating in the opposite direction. Therefore, in a conventional pump in which two pistons change direction simultaneously, there is a short time during which neither of the pistons is pumping at full pressure. This results in a brief drop in pressure drop of the outlet fluid. The feature of the invention described in the previous paragraph reduces the amount of this pressure drop.

The above description is for a 3-cylinder/piston pumping arrangement and (as will become clear) it is usually preferable for pumps to include three or more cylinders/pistons. However, the principles of operation could also be applied to a two-cylinder/piston arrangement, where each piston is driven by a cam having a cam profile in which more than half of the cam rotation cycle is used to drive the piston in the pumping stroke, and the remainder (less than half) of the cam rotation is used for the return stroke. For the two-cylinder arrangement this means that for part of the rotational cycle both pistons will be pumping. At other times in the cycle only one piston will be pumping while the other piston is on its return stroke. This means that the pressure or flow rate will vary throughout the cam cycle and give rise to a cyclical or "pulsing" type of flow. In many applications such types of flow are not desirable, and can be avoided using pumps with three or more cylinders/pistons as described above and below. However, there may be applications where this type of flow does not cause a problem. Therefore embodiments may also include pumps with just two cylinders/pistons. A two-cylinder arrangement of this type may still produce a higher average pressure than a two-cylinder pump in which the pistons are always 180 degrees out of phase such that only one piston is pumping at any given time.

Figure 4A:
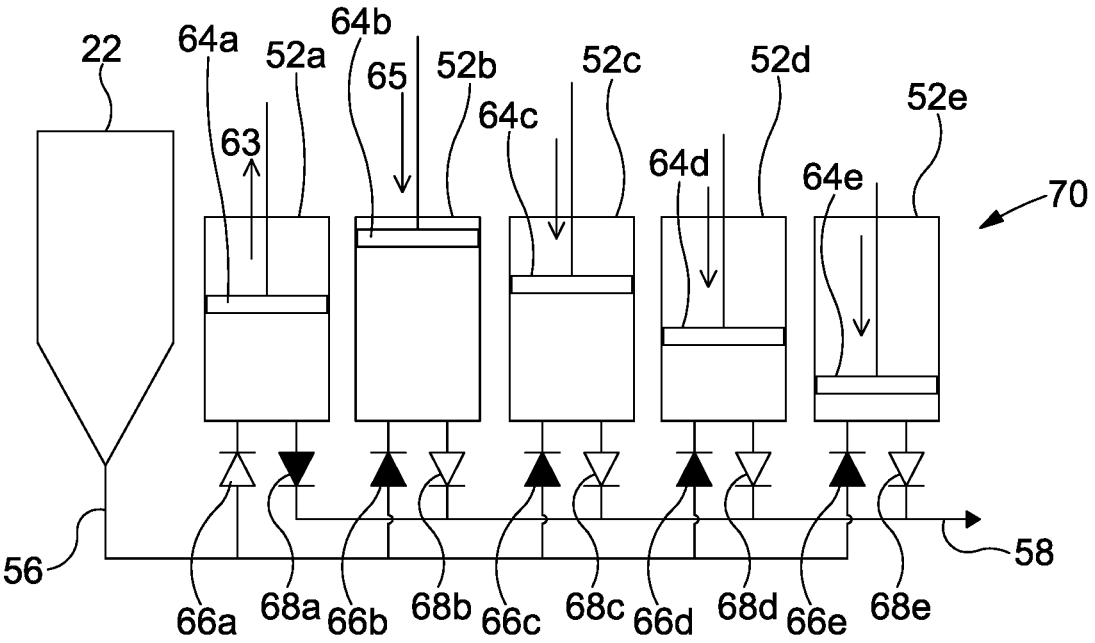
FIG. 4*a* is a diagram illustrating one principle of operation of a 5-cylinder high pressure pump.
Figure 4B:
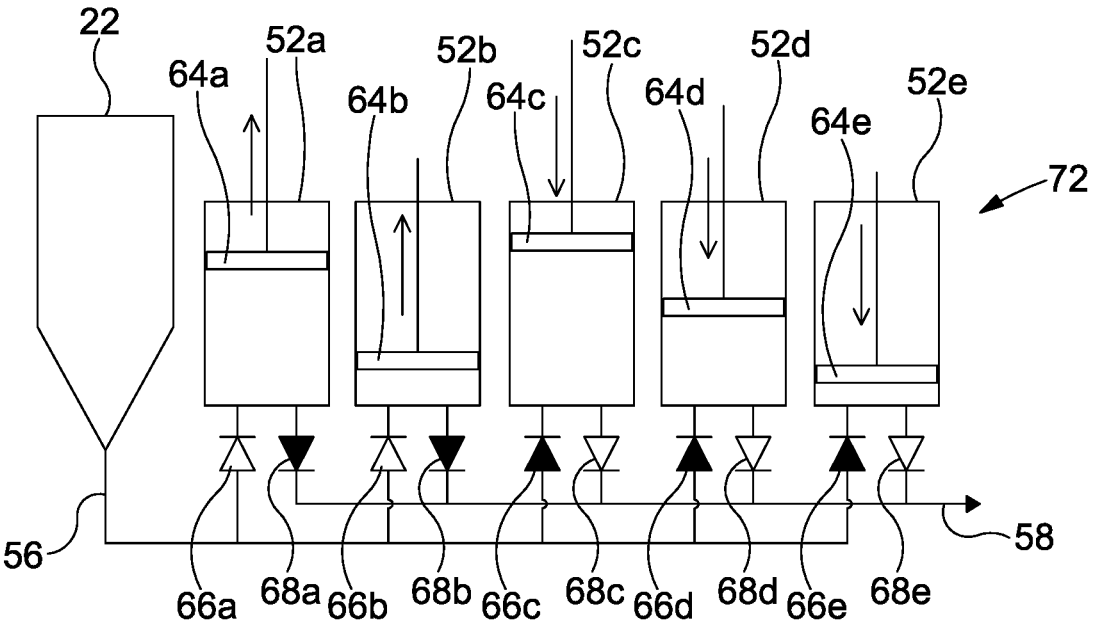
FIG. 4*b* is a diagram illustrating another principle of operation of a 5-cylinder high pressure pump.

FIGS. 4*a* and 4*b* illustrate some principles of operation of a 5-cylinder positive displacement pump, as one alternative to the 3-cylinder arrangement of FIGS. 3, 3*a* and 3*b*. In both of these embodiments, the individual cylinders 52, pistons 64, inlet check valves 66 and outlet check 68 operate in the same manner as described above with respect to FIGS. 3*a* and 3*b*.

FIG. 4*a* illustrates a 5-cylinder positive displacement pump 70, in which the cams (not shown) are shaped such that the drawing stroke occurs over a time period which is less than a quarter the time period of the pumping stroke. The cams are arranged to drive the pistons out of phase with one another such that at any position during the rotation cycle, at least four of the pistons are pumping. At the point in the cycle shown by FIG. 4*a*, piston 64*a* is in the drawing stroke while pistons 64*b*, 64*c*, 64*d*, 64*e* are in the pumping stroke.

FIG. 4*b* illustrates a 5-cylinder positive displacement pump 72, in which the cams (not shown) are shaped such that the drawing stroke occurs over a time period which is less than two thirds the time period of the pumping stroke. The cams are arranged to drive the pistons out of phase with one another such that at any position during the rotation cycle, at least three of the pistons are pumping. At the point in the cycle shown by FIG. 5, pistons 64*a*, 64*b* are in the drawing stroke while pistons 64*c*, 64*d*, 64*e* are in the pumping stroke.

As in the 3-cylinder positive displacement pump arrangement, the cams in the 5-cylinder positive displacement pump 70, 72 may be arranged in such a way that a change in direction of movement of any piston from pumping to drawing occurs a small angle of rotation of the cams after another piston has changed direction of movement from drawing to pumping. Again, this small angle of rotation of the cams is typically less than 5 degrees and may be less than 2 degrees in some cases. As described above, this feature avoids the brief pressure drop in the outlet fluid which occurs when two pumps change direction simultaneously.

Figure 5:
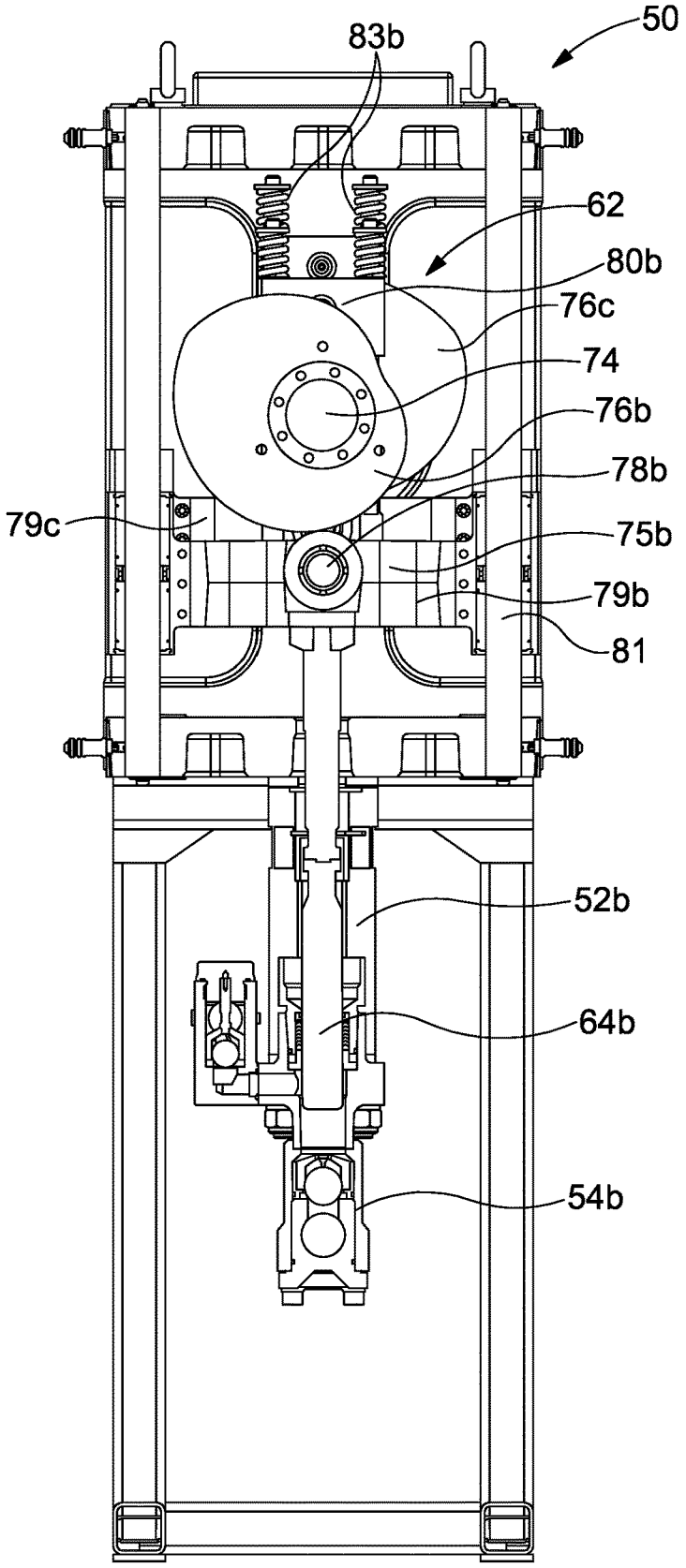
FIG. 5 is a side elevation of a section through the 3-cylinder high pressure positive displacement pump of FIGS. 2*a* and 2*b*, demonstrating a cam arrangement.

Referring to FIG. 5, there is shown a side elevation of a section through the 3-cylinder high pressure positive displacement pump 50 of FIGS. 1 and 2, demonstrating the cam arrangement 62 that provides actuating movement of the pistons 64, as described above with reference to FIGS. 2*a*, 2*b*, 3*a* and 3*b*. The cam arrangement 62 includes, for each of the three cylinders 52*a-c*, a main cam 76*a-c*, a return cam (not shown in FIG. 5), and a follower assembly 75*a-c*. The cam arrangement 62 further includes a cam shaft 74. In FIG. 5, most of the components shown relate to one of the three cylinders, 52*b*, although parts of some components that relate to another of the cylinders, 52*c*, are also visible.

Follower assemblies 75*a-c* each include a main follower wheel 78*a-c*, a return follower wheel 80*a-c*, a slider 79*a-c*, a follower frame 81*a-c* and a pair of springs 83*a-c* (see also FIGS. 1 and 2). The springs 83*a-c* ensure that the respective follower wheels 78*a-c* are urged against the surface of the rotating cams at all times and that no backlash arises as a result of any wear to the contacting surfaces. Rotation of cam shaft 74 causes translation of main follower wheel 78*a-c* and return follower wheel 80*a-c*, as is described below with reference to FIG. 6. The axes of each of the main follower wheels 78*a-c* and return follower wheels 80*a-c* are fixed to the respective slider 79*a-c*, which is fixed to piston 64. Follower frames 81*a-c* constrain the sliders 79*a-c* to translate linearly, resulting in axial translation of pistons 64*a-c* within cylinder 52.

Figure 6:
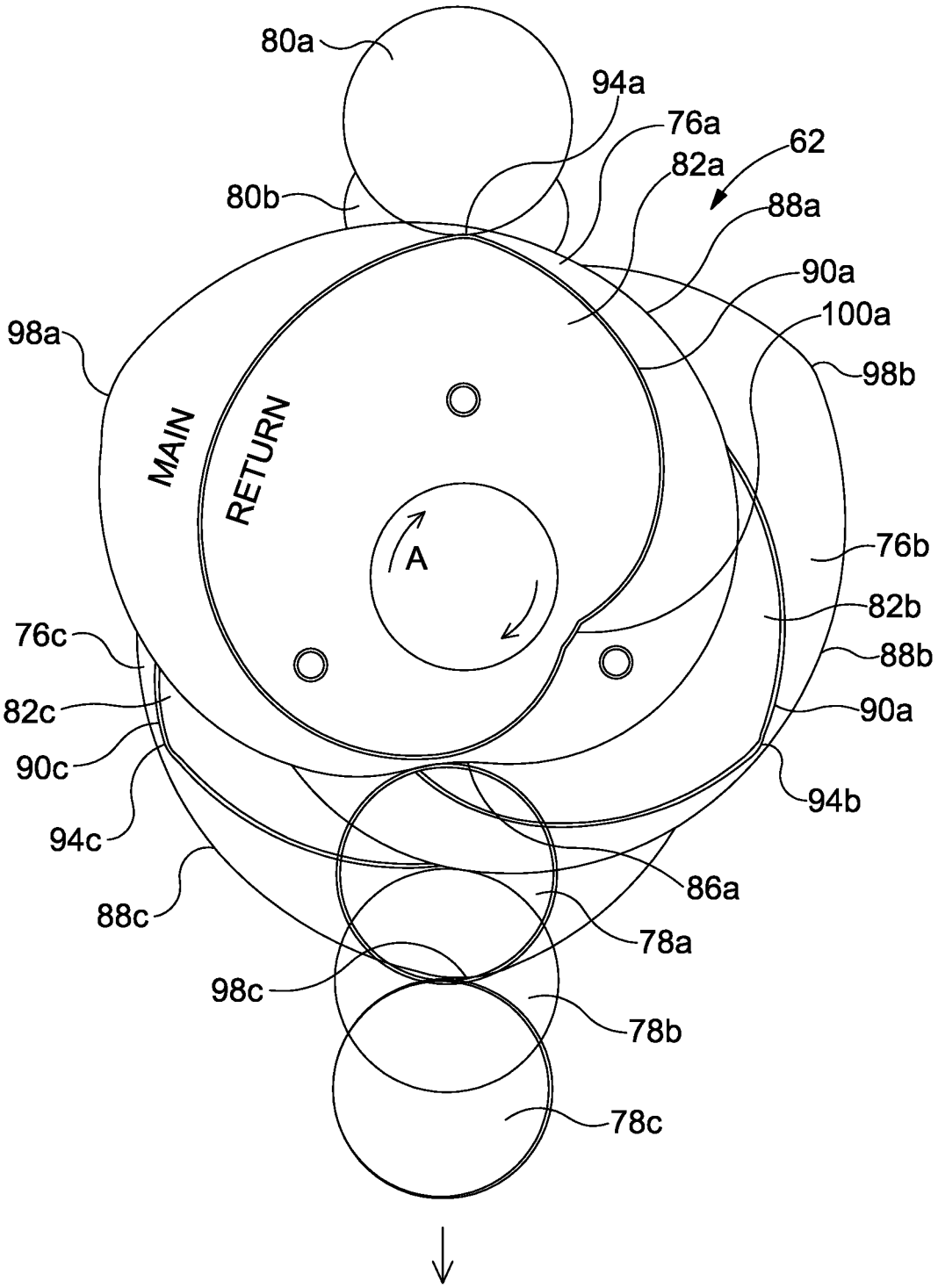
FIG. 6 is a diagram showing cam profiles of the cam arrangement of FIG. 5.

Referring to FIG. 6, there is shown a diagram of the cam profiles of the cam arrangement 62. The cam arrangement 62 includes a cam shaft 74, to which three main cams 76*a-c* and three return cams 82*a-c* are fixed. Each of the main cams 76*a-c* includes a main cam surface 88*a-c*, which is in rolling contact with a main follower wheel 78*a-c*. The main follower wheels 78*a-c* are positioned in between the main cams 76*a-c* and the cylinders 52*a-c*. Each of the return cams 82*a-c* includes a return cam surface 90*a-c*, which is in rolling contact with one of the return follower wheels 80*a-c*. The return cams 82*a-c* are positioned in between the return follower wheels 80*a-c* and the cylinders 52*a-c*. In some embodiments, each of the main cams 76*a-c* is integrally formed with its corresponding return cam 82*a-c*. This results in three integral cam components, one for each piston/cylinder, each of which has a main cam surface 88*a-c* and a return cam surface 90*a-c*, with the surfaces offset from each other along the direction of the axis of the cam shaft 74.

The main cam surfaces 88*a-c* includes a main cam top displacement point 86*a-c* and a main cam bottom displacement point 98*a-c*. Each of the return cam surfaces 90*a-c* includes a return cam top displacement point 94*a-c* and a return cam bottom displacement point 100*a-c*.

At the point in the cycle shown in FIG. 6, piston 64*a*, which is associated with main cam 76*a* and return cam 82*a*, is at its top position in cylinder 52*a*. This means that piston 64*a* is about to begin its pumping phase. At this point, the main cam top displacement point 86*a* is in contact with the main follower wheel 78*a*, and at this point the main cam radius is at its minimum. The return cam top displacement point 94*a* is in contact with return follower wheel 80*a*, and at this point the return cam radius is at its maximum.

During the pumping phase of the piston 64*a*, the main cam surface 88*a* remains in contact with main follower wheel 78*a*. The cam shaft 74, and the main cams 76*a-c* and return cams 82*a-c* rotate in the direction shown by the arrow A.

At the beginning of the pumping phase of the piston 64*a*, when the piston is at its top position within cylinder 52*a*, the translational velocities of the piston 64*a* and the main follower wheel 78*a* are instantaneously zero. For the majority of the pumping phase, the main cam radius at the point of contact with main follower wheel 78*a* increases linearly with rotation of the cam shaft 74, resulting in constant downwards translational velocity of the main follower wheel 78*a*, and corresponding motion of the piston 64*a* within the cylinder 52*a*. However, the linear increase in main cam radius cannot be achieved close to the main cam top displacement point 86*a*, as the main cam surface 88*a* is shaped to accommodate the main follower wheel 78*a* (which has a finite radius) at this point. Therefore, at the beginning of the pumping phase, the piston 64*a* accelerates over a short time period from zero to the constant velocity described above.

Following the acceleration described in the previous paragraph, the piston 64*a* continues to travel at constant velocity until close to the end of the pumping phase, when the cam shaft 74 has rotated through approximately 240 degrees and the main cam bottom displacement point 98*a* has almost reached the main follower wheel 78*a*. The piston 64*a* decelerates from its constant velocity to zero over a short time period, until the main cam bottom displacement point 98*a* has reached the main follower 78*a*, at the end of the pumping phase of piston 64*a*. The main cam radius is at its maximum when the follower wheel is in contact with main cam bottom displacement point 98*a*.

At the end of the pumping phase of the piston 64*a*, the piston 64*a* is at its bottom position within cylinder 52*a*, and has instantaneously zero velocity. The return cam bottom displacement point 100*a* is in contact with return follower wheel 80*a*, and the return cam radius is at its minimum.

Following the pumping phase of the piston 64*a*, the drawing phase begins. During the drawing phase, return cam surface 90*a* remains in contact with return follower wheel 80*a*. The cam shaft 74, and the main cams 76*a-c* and return cams 82*a-c* continue to rotate in the direction shown by the arrow A.

At the beginning of the drawing phase of the piston 64*a*, when the piston is at its bottom position within cylinder 52*a*, the translational velocities of the piston 64*a* and the return follower wheel 82*a* are instantaneously zero. For the majority of the drawing phase, the return cam radius 96*a* at the point of contact with return follower wheel 80*a* increases linearly with rotation of the cam shaft 74, resulting in constant velocity upwards translation of the return follower wheel 80*a*, and corresponding upwards motion of the piston 64*a* within the cylinder 52*a*. However, constant velocity cannot be maintained close to the return cam bottom displacement point 100*a*, as the return cam surface 88*a* is shaped to accommodate the return follower wheel 80*a* (which also has finite radius) at this point. Therefore, instantaneous deceleration and acceleration cannot be achieved. Therefore, at the beginning of the drawing phase, the piston 64*a* accelerates over a short time period from zero to the constant velocity described above.

Following the acceleration described in the previous paragraph, the piston 64*a* continues to travel at this constant velocity until near to the end of the drawing phase, when the cam shaft 74 has rotated through a further approximately 120 degrees and the return cam top displacement point 94*a* has almost reached the return follower wheel 80*a*. The piston 64*a* decelerates from the constant velocity to zero over a short time period, until the return cam top displacement point 94*a* is in contact with the return follower wheel 80*a*, at the end of the drawing phase of piston 64*a*, in the position shown in FIG. 6. Again, an instantaneous deceleration cannot be achieved at the return cam top displacement point 94*a*.

The main cams 76*a-c* and return cams 82*a-c* are shaped such that the constant speed at which the pistons 64*a-c* travel during the pumping phase is approximately half of the constant speed at which the pistons travel during the drawing phase. Main cams 76*b*, 76*c* and return cams 82*b*, 82*c* operate in the same manner as main cam 76*a* and return cam 82*a* described above. At all points during the cycle, main cam 76*a* and return cam 82*a* are 120 degrees out of phase with main cam 76*b* and return cam 82*b*, respectively. Main cam 76*b* and return cam 82*b* are 120 degrees out of phase with main cam 76*c* and return cam 82*c*, respectively. This gives the actuating movement of the pistons 64*a*, 64*b*, 64*c* described above with reference to FIGS. 3*a* and 3*b*.

Note that there are constant velocity profiles for both stroke directions of both the main cams and the return cams. It might seem that a constant velocity profile is unnecessary for the return cam when the main cam is driving the piston on the pumping stroke (or equally that a constant velocity profile is unnecessary for the main cam during the return stroke). However the constant velocity profiles ensure that the followers maintain contact with the cam surfaces for the entire 360-degree rotational cycle, because the springs 83*a-c* urge each of the followers to their cam. This is advantageous because if contact between a follower and a cam surface is lost, even for a short time, this can give rise to a bouncing or knocking effect that increases wear of the follower and cam surfaces.

Figure 7:
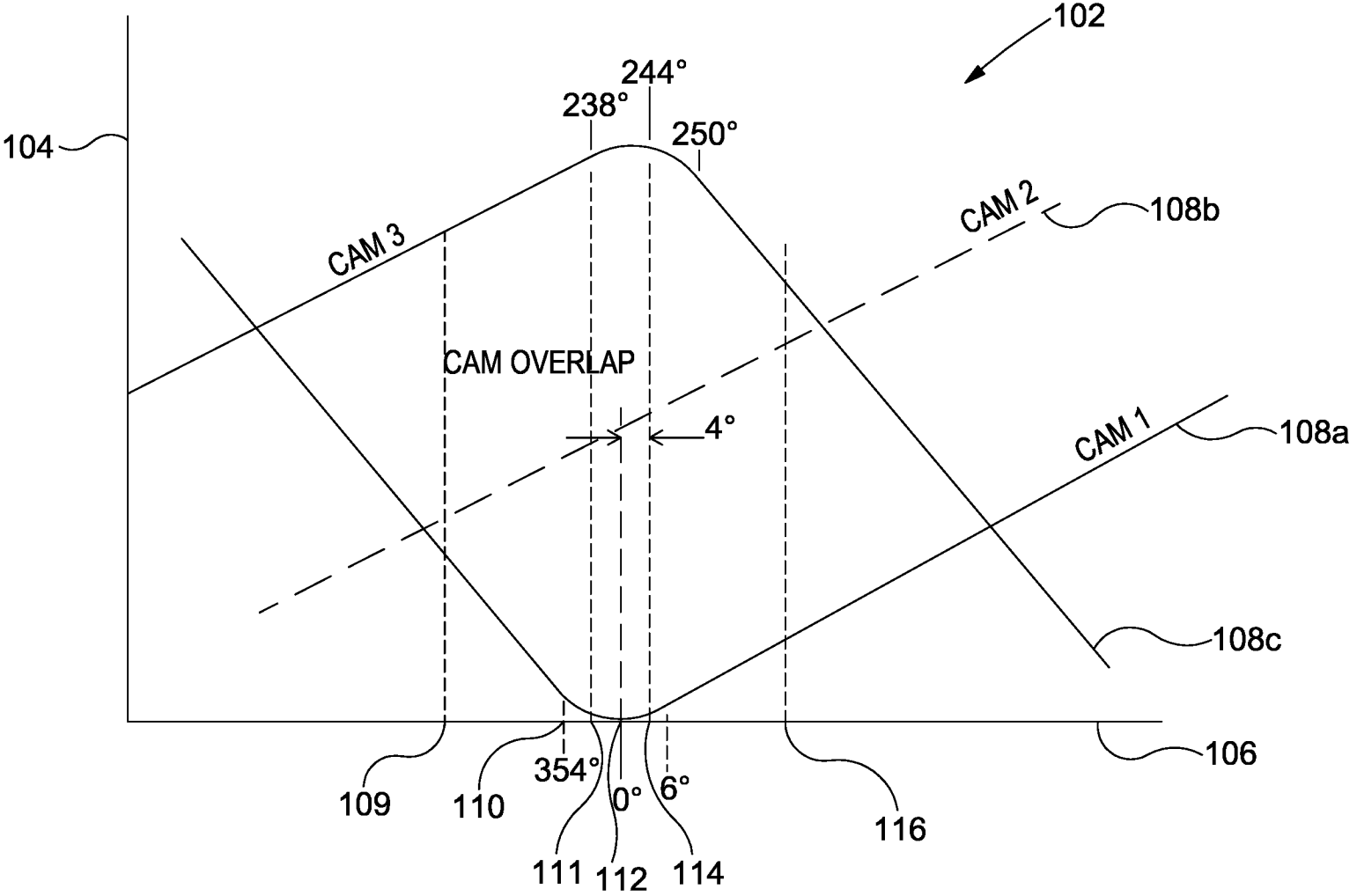
FIG. 7 is a plot showing a cam orientation diagram for a cam arrangement for the 3-cylinder high pressure pump.

Referring to FIG. 7, there is shown a cam orientation diagram 102 for a cam arrangement 62 for the 3-cylinder high pressure pump 50. Cam orientation diagram 102 plots cam displacement 104 against cam rotation 106. In FIG. 7, the direction of rotation of the cams is from left to right along the graph axis of cam rotation 106. A positive cam displacement corresponds to downward motion of pistons 64 within cylinders 52. A single curve 108*a*, 108*b*, 108*c* is given for each combination of main cam 76*a*, 76*b*, 76*c* and return cam 82*a*, 82*b*, 82*c* associated with each piston 64*a*, 64*b*, 64*c*.

At first cam rotation angle 109, curve 108*a* has a negative gradient, indicating that piston 64*a* is travelling upwards in cylinder 52*a*, in its drawing phase. Curves 108*b* and 108*c* have positive gradients, indicating that pistons 64*b* and 64*c* are both travelling downwards in cylinders 52*b*, 52*c*, during their pumping phases. This is as described above with respect to FIG. 3*a*.

As all of the curves 108*a-c* have constant gradients at first cam rotation angle 109, all of the pistons 64 are travelling at constant velocities. The magnitude of the gradient of curve 108*a* is double that of curves 108*b*, 108*c*, indicating that piston 64*a* is travelling at double the speed of pistons 64*b*, 64*c*.

As cam rotation angle increases from first cam rotation angle 109, pistons 64*a*, 64*b*, 64*c* continue to travel at the same constant velocities until second cam rotation angle 110 is reached. At this angle, the negative gradient of curve 108*a* begins to increase, indicating that the speed of piston 64*a* is falling. The reason for this is explained above with respect to FIG. 6.

As cam rotation angle increases from second cam rotation angle 110, the speed of piston 64*a* continues to fall, while pistons 64*b*, 64*c* continue travelling at the same constant velocities, until third cam rotation angle 111 is reached. At this angle, the positive gradient of curve 108*c* begins to decrease, indicating that the speed of piston 64*c* is also falling. Again, the reason for this is explained above with respect to FIG. 6.

As cam rotation angle increases from third cam rotation angle 111, piston 64*b* continues travelling at the same constant velocity, while the speeds of pistons 64*a*, 64*c* continue to fall, until fourth cam rotation angle 112 is reached. At this angle, curve 108*a* is at its minimum cam displacement, indicating that piston 64*a* is instantaneously stationary at the top of cylinder 52*a*, having just completed its drawing phase. Again, curves 108*b* and 108*c* have positive gradients, indicating that pistons 64*b* 64*c* are in their pumping phases.

As cam rotation angle increases from fourth cam rotation angle 112, the gradient of curve 108*a* begins to increase, indicating that piston 64*a* is accelerating in the downwards direction at the beginning of its pumping phase, while piston 64*b* continues travelling at the same constant velocity. The gradient of curve 108*c* remains positive until fifth cam rotation angle 114 is reached. At fifth cam rotation angle 114, curve 108*c* is at its maximum cam displacement, indicating that piston 64*c* is instantaneously stationary at the bottom of cylinder 52*c*, having just completed its pumping phase. This means that in between fourth cam rotation angle 112 and fifth cam rotation angle 114, all three curves 108*a*, 108*b*, 108*c* have positive gradients, indicating that all three pistons 64*a* 64*b* 64*c* are pumping, as is described above with respect to FIG. 3*b*. This occurs in this case because the pumping phase takes place over 244 degrees of cam rotation, while the drawing phase takes place over 116 degrees of cam rotation.

Cam rotation angle increases further up to sixth cam rotation angle 116. At this angle, curves 108*a*, 108*b* have constant positive gradients, indicating that pistons 64*a*, 64*b* are both travelling downwards at constant velocity in cylinders 52*a*, 52*b*, as part of their pumping phases. Curve 108*c* has a constant negative gradient, indicating that piston 64*c* is travelling upwards at constant velocity in cylinder 52*c*, in its drawing phase.

Figure 8:
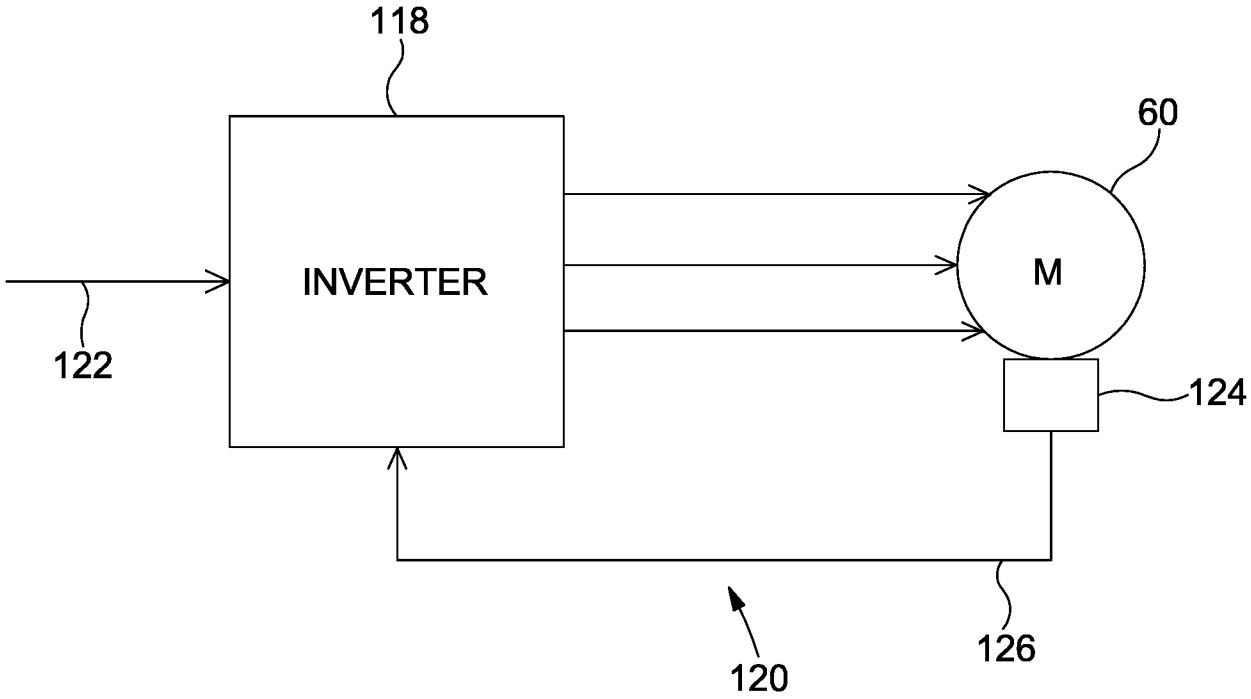
FIG. 8 is a schematic diagram of a closed loop vector control system for a three-phase ac motor.

The variable speed electric motor 60, which drives the cam arrangement as described above so as to provide a reciprocating drive to the pistons, may be any type of electric motor capable of being controlled to vary its speed. However, embodiments may utilise a variable speed ac motor. A particularly advantageous arrangement utilises a variable speed ac motor. As shown in FIG. 8, the variable speed ac motor drive may be controlled by the controller, which has an inverter 118 with a closed loop vector drive control 120. When an ac motor runs at relatively high speed, although there is some slippage between the stator and rotor positions relative to the phase angle of the ac drive current, this slippage can be tolerated because it is usually only a small angle provided the drive torque is not excessive. Thus, in the vast majority of ac motor drive applications no adjustment needs to be made for this slippage, and the inverter used to control the current supplied to the motor windings operates using an open-loop vector control. However, such motors are not suitable for operation at very low speeds, as the slippage can cause the motor to stall. For most applications this is not a problem, but for the pumps described above, such as pumps for pumping mastic, it is required to provide and maintain a high pressure to the fluid/mastic even when the quantity of mastic being used is very small (or zero). This means that the pumps 24, 26 must be capable of maintaining a high pressure—or in other words that the pistons of the positive displacement pumps continue to apply force to the fluid in the pump cylinders even when the pistons are not moving. Therefore the ac motor 60 must maintain a torque on the cam shaft even when this is not rotating, and this can only happen if the ac motor does not stall. Accordingly, the ac motor 60 inverter uses a closed loop vector control.

Referring to FIG. 8, there is shown a schematic diagram of a closed loop vector control system 120 for a three-phase ac motor 60, which may be used to drive the pump 50, 70. The closed loop vector control system 120 includes an inverter 118 connected to the three phases of the motor 60. The motor 60 includes a feedback device 124, which is connected to the inverter 118 by a feedback loop 126.

In closed loop vector control 120, a reference signal 122 is passed to inverter, to specify the desired motor speed. The feedback device 124 measures the position and speed of the motor 60. This measured speed and position is passed to inverter 118 via feedback loop 126. The inverter 118 uses the position measurement to determine which phase of the motor 60 requires current at a particular time. The inverter 118 also compares the measured motor speed to the desired speed, to determine the current to be provided to the motor 60. There are a number of different ways that feedback device 124 can determine the motor position and speed. As but one example, the ac motor 60 may have a shaft encoder that provides a signal to the inverter.

Another beneficial feature of the ac motor 60 is a forced convection fan arranged to provide cooling air to windings of the motor. At normal high rotational speeds, the rotation of the windings through the air usually provides sufficient cooling to keep the windings from overheating. When the ac motor 60 is rotating at very low speeds, or is stationary but still applying pressure to the fluid/mastic, the lack of movement means that there is no air flow past the motor windings. However, the windings continue to be supplied with a current to provide the required torque to the cams, and so will generate heat, which is removed by the air blown from the forced convection fan 61.

Embodiments of the invention may provide for a particularly advantageous arrangement in that a single high pressure pump may be used, rather than the four or more low capacity high pressure pumps which are typically used in known systems. This is because the high pressure pump can operate over a much larger range of flow rates than existing pumps, allowing the single high pressure pump to provide all of the flow rates required.

The pump 50 and its controller keep the pressure at the outlet of the pump 50 at a pre-set value, independent of the flow rate of the pump, as in a true pressure closed loop control system. For example, a pressure sensor (not shown) may be used to provide a pressure signal to the controller for this purpose. In the known systems referred to above, the smaller capacity pumps only start to pump when the pressure in the line at the outlet of the pumps drops, with flow increasing as the pressure continues to drop. This leads to the dynamic pressure in the system being much lower than the static pressure, which has a detrimental effect on the system and the process.

The invention claimed is:

1. A positive displacement pump for pumping a fluid mastic, the pump comprising:

a plurality of cylinders each having a piston arranged for reciprocal motion within the cylinder, whereby movement of the piston in a first direction draws the fluid into the cylinder and movement in a second, opposite direction pumps the fluid out of the cylinder; and a variable speed electric motor drivingly coupled to a cam arrangement via a cam shaft and providing a reciprocating drive to the pistons, wherein the variable speed electric motor is an ac motor having an inverter and a forced convection fan arranged to provide cooling air to windings of the ac motor, and wherein the inverter has a closed loop vector drive control, wherein the cam arrangement comprises cams shaped and arranged to drive each piston in the first direction over less than half of a rotational cycle and to drive each piston in the second direction over the remainder of the rotational cycle, wherein the cams are arranged to drive the pistons out of phase with one another, and wherein the cam arrangement includes, for each piston, a first cam and cam follower and a second cam and cam follower, 180° out of phase with the first cam and cam follower relative to the cam shaft, wherein the first and second cam followers are connected to each other such that the distance between the first and second cam followers is always the same, and cam surfaces are shaped to ensure that the cam followers maintain contact with the respective cams at all times.

2. The positive displacement pump of claim 1, comprising three or more cylinders, wherein the cams are arranged to drive the pistons such that, at any position of the rotational cycle more than half of the pistons are being driven in the second direction.

3. The positive displacement pump of claim 1, wherein the cams are arranged such that a change in the direction of movement of any piston from the second direction to the first direction occurs at an angle of less than 5 degrees of rotation of the cams after another piston has changed direction from the first direction to the second direction, thereby providing that an increased number of pistons are pumping fluid prior to each change of direction of a piston from the second direction to the first direction.

4. The positive displacement pump of claim 3, wherein the angle of less than 5 degrees of rotation of the cams is an angle of less than 2 degrees.

5. The positive displacement pump of claim 1, wherein the ac motor has a shaft encoder providing a signal indicating a position of a rotor to the inverter.

6. A positive displacement pump for pumping a fluid mastic, the pump comprising:

a plurality of cylinders each having a piston arranged for reciprocal motion within the cylinder, whereby movement of the piston in a first direction draws the fluid into the cylinder and movement in a second, opposite direction pumps the fluid out of the cylinder; and a variable speed ac motor drivingly coupled to a cam arrangement via a cam shaft and providing a reciprocating drive to the pistons, wherein the variable speed ac motor has an inverter and a forced convection tan arranged to provide cooling air to windings of the variable speed ac motor, the inverter having a closed loop vector drive control, and wherein the cam arrangement includes, for each piston, a first cam and cam follower and a second cam and cam follower, 180° out of phase with the first cam and cam follower relative to the cam shaft, wherein the first and second cam followers are connected to each other such that the distance between the first and second cam followers is always the same, and cam surfaces are shaped to ensure that the cam followers maintain contact with the respective cams at all times.

7. The positive displacement pump of claim 6, wherein the variable speed ac motor has a shaft encoder providing a signal indicating a position of a rotor to the inverter.

8. The positive displacement pump of claim 6, wherein the cam arrangement comprises the cams shaped and arranged to drive each piston in the first direction over less than half of a rotational cycle and to drive each piston in the second direction over the remainder of the rotational cycle, and wherein the cams are arranged to drive the pistons out of phase with one another.

9. The positive displacement pump of claim 8, comprising three or more cylinders, wherein the cams are arranged to drive the pistons such that, at any position of the rotational cycle more than half of the pistons are being driven in the second direction.

10. The positive displacement pump of claim 8, wherein the cams are arranged such that a change in the direction of movement of any piston from the second direction to the first direction occurs at an angle of less than 5 degrees of rotation of the cams after another piston has changed direction from the first direction to the second direction, thereby providing that an increased number of pistons are pumping fluid prior to each change of direction of a piston from the second direction to the first direction.

11. The positive displacement pump of claim 10 wherein the angle of less than 5 degrees of rotation of the cams is an angle of less than 2 degrees.

12. The positive displacement pump of claim 6, wherein springs urge the cam followers to maintain contact with their respective cams.

13. The positive displacement pump of claim 6, wherein the cam arrangement comprises the cams having constant velocity cam surface profiles.

* * * * *